US006150599A

United States Patent [19]

Fay et al.

[11] Patent Number: 6,150,599

[45] Date of Patent: Nov. 21, 2000

[54] DYNAMICALLY HALTING MUSIC EVENT STREAMS AND FLUSHING ASSOCIATED COMMAND QUEUES

[75] Inventors: Todor C. Fay, Bellevue; Mark T. Burton, Redmond, both of Wash.

[73] Assignee: Microsoft Corporation, Redmond, Wash.

[21] Appl. No.: 09/243,072

[22] Filed: Feb. 2, 1999

[51] Int. Cl.[7] ..... A63H 5/00; G04B 13/00; G10H 7/00

[52] U.S. Cl. ..... 84/609; 84/634; 84/637; 84/645

[58] Field of Search ..... 84/609, 634, 637, 84/645

[56] References Cited

U.S. PATENT DOCUMENTS

| | | | |
|---|---|---|---|
| 4,526,078 | 7/1985 | Chadabe | 84/1.03 |
| 4,716,804 | 1/1988 | Chadabe | 84/1.03 |
| 5,052,267 | 10/1991 | Ino | 84/613 |
| 5,164,531 | 11/1992 | Imaizumi et al. | 84/634 |
| 5,179,241 | 1/1993 | Okuda et al. | 84/613 |
| 5,218,153 | 6/1993 | Minamitaka | 84/613 |
| 5,278,348 | 1/1994 | Eitaki et al. | 84/636 |
| 5,281,754 | 1/1994 | Farrett et al. | 84/609 |
| 5,286,908 | 2/1994 | Jungleib | 81/603 |
| 5,300,725 | 4/1994 | Manabe | 84/645 X |
| 5,315,057 | 5/1994 | Land et al. | 84/601 |
| 5,355,762 | 10/1994 | Tabata | 84/609 |
| 5,455,378 | 10/1995 | Paulson et al. | 84/610 |
| 5,496,962 | 3/1996 | Meier et al. | 84/601 |
| 5,557,424 | 9/1996 | Panizza | 358/335 |
| 5,640,590 | 6/1997 | Luther | 395/806 |
| 5,734,119 | 3/1998 | France et al. | 84/645 X |
| 5,753,843 | 5/1998 | Fay | 84/609 |
| 5,827,989 | 10/1998 | Fay et al. | 84/645 |
| 5,883,957 | 3/1999 | Moline et al. . | |

*Primary Examiner*—Jeffrey Donels
*Attorney, Agent, or Firm*—Lee & Hayes, PLLC

[57] ABSTRACT

A system for processing music events includes a plurality of different music sources that provide music events to a performance manager. In response to receiving a music event, the performance manager calculates a time sequence of individual MIDI commands to implement the music event, and places a first of these events in a command queue. The performance manager monitors the command queue, and removes and processes individual commands from the command queue at the times indicated by their timestamps. Upon removing a non-concluding individual command of particular time sequence from the command queue, the music processing component determines a subsequent individual command of the particular time sequence and places it in the command queue. Upon receiving a flush instruction for a particular music source, the performance manager identifies any individual commands in the command queue corresponding to the music source, processes any of the commands that are off commands, and discards any other commands. Certain commands have associated reset values that are applied when the commands are removed from the queue in response to a flush instruction.

43 Claims, 4 Drawing Sheets

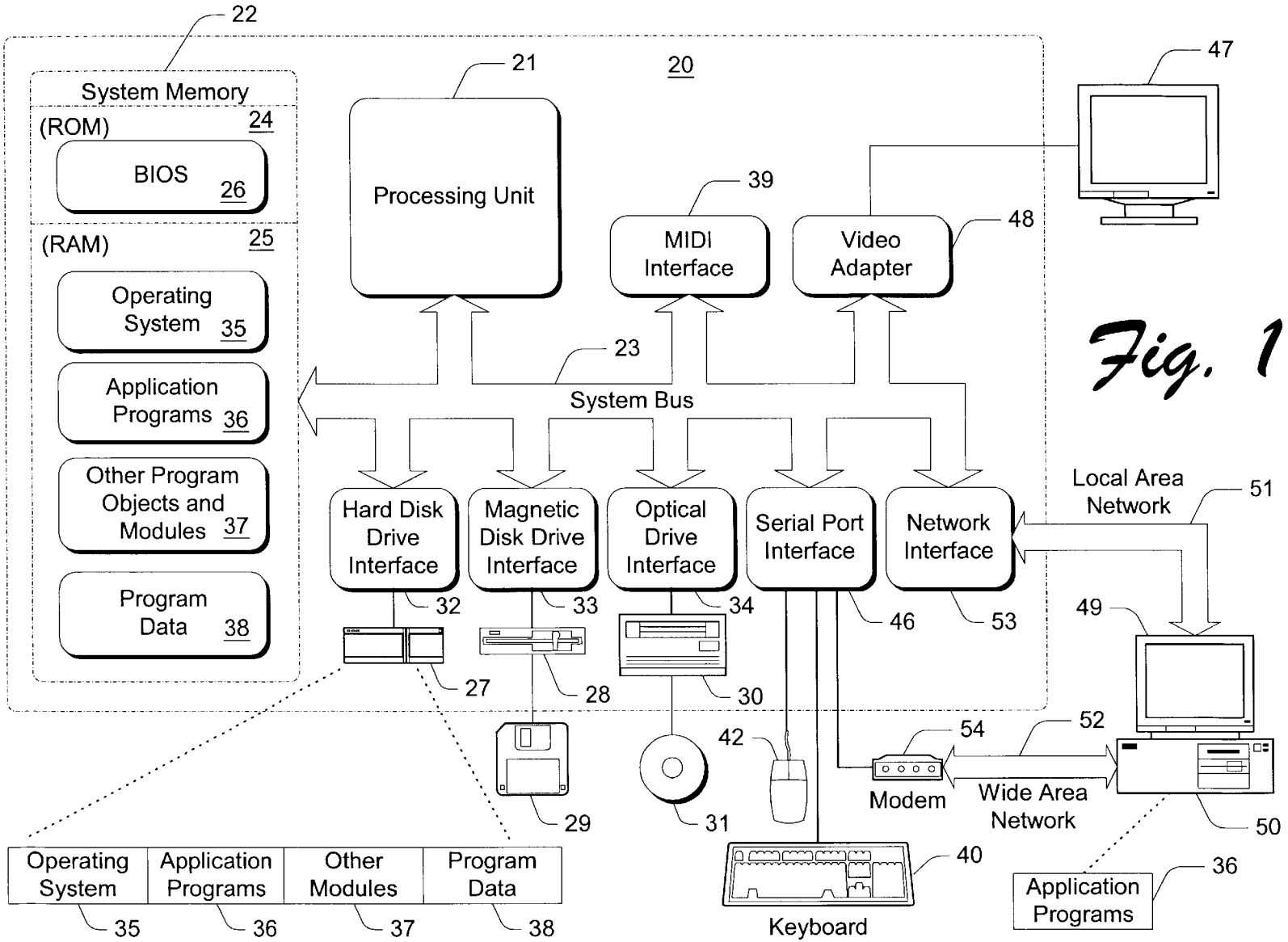
Fig. 1
20
21
Processing Unit
22
System Memory
(ROM)
24
BIOS
26
(RAM)
25
Operating System
35
Application Programs
36
Other Program Objects and Modules
37
Program Data
38
23
System Bus
Video Adapter
48
MIDI Interface
39
Network Interface
53
Serial Port Interface
46
Optical Drive Interface
34
Magnetic Disk Drive Interface
33
Hard Disk Drive Interface
32
47
Local Area Network
51
49
50
52
Wide Area Network
54
Modem
42
Keyboard
40
30
31
28
29
27
Operating System
35
Application Programs
36
Other Modules
37
Program Data
38
Application Programs
36

DYNAMICALLY HALTING MUSIC EVENT STREAMS AND FLUSHING ASSOCIATED COMMAND QUEUES

TECHNICAL FIELD

This invention relates to systems for playing different music streams, in which individual streams can be dynamically halted without reaching their conclusion. More specifically, the invention relates to methods of halting such streams while negating any potentially lingering effects of such streams.

BACKGROUND OF THE INVENTION

The MIDI (Musical Instrument Data Interface) standard has become almost universally accepted as a method of communicating music performance data. MIDI was designed primarily for communication between discrete components such as keyboards and synthesizers. However, MIDI is now used quite extensively to generate music in personal computers. Although the availability of such an accepted standard is very beneficial, there are some drawbacks to using the MIDI standard in computers.

MIDI represents music as a series of discrete events. One of the most basic examples involves playing a single note. In the MIDI standard, a note is played by sending a "note-on" event to a synthesizer or other rendering device and then sending a "note-off" event. The synthesizer starts playing the note immediately upon receiving the note-on event, and continues playing the note until receiving the note-off event. This makes sense when the music events are being generated by a keyboard, because each event corresponds to an actual, physical event taking place at the keyboard: the note-on event corresponds to pressing a key, and the note-off event corresponds to releasing the key. It makes sense for the keyboard to send a notification when an event occurs, and for the synthesizer to respond whenever it receives the notification.

When music is generated by a computer, however, low-level events are not typically generated in response to physical events. When a computer generates a note, it is more convenient to specify the note and its duration. This reduces the work of whatever high-level program is generating music; the program can send a note once to a synthesizer, rather than the two times that would be required to send a note-on notification and a subsequent note-off notification.

Another reason for specifying notes by duration is to avoid confusion that might otherwise result when a synthesizer simultaneously renders different incoming MIDI streams. Each stream can have note-on and note-off commands concerning the same notes. This can produce especially difficult problems when it is desired to prematurely halt the music from one of the streams. If the command stream is simply discontinued, some notes will be left "stuck" on, since the appropriate note-off commands are never sent.

In some computer-based systems, note commands are send ahead of time to a rendering component. The rendering component places future note commands from the different streams in a common time queue, for playback at designated times. When halting a stream, it is necessary not only to interrupt the command stream itself, but to flush the time queue. However, simply removing all of the note commands that originated from a particular stream might have the undesirable effect of leaving a note stuck on, because the note-off event for that note might be removed from the queue after its corresponding note-on has been played.

One solution to this problem of stuck notes has been to simply command "all notes off" when terminating a particular stream. Another, less drastic solution has been to immediately play any note-off commands that are currently in a queue, and then removing the commands from the queue. However, either of these approaches might interfere with notes generated by other streams. A more complex (but more effective) approach is to maintain a table indicating the status of each note. For each "on" note, the table indicates the stream responsible for turning the note on. When a stream is terminated, the table can be examined to determine which notes need to be turned off. Although this method is workable, it is somewhat awkward and inefficient.

Similar problems occur with incremental MIDI commands that represent a series of small, incremental control movements. For example, such incremental commands can be generated in response to a pitch-bend controller on a MIDI keyboard. The controller is a wheel that can be turned by the user to gradually "bend" (change the pitch of) current notes. The wheel typically has a spring-return to a neutral position. Rotating the wheel results in a series of MIDI events, each corresponding to a small incremental rotation of the wheel. In this physical environment, the wheel eventually returns to its neutral position, thus terminating the "bend" and returning the pitch to its original value. Controllers such as this can be used to vary other real-time parameters such as volume.

Computer programs can use incremental MIDI commands to create desired music effects. However, dynamically halting a MIDI stream in the middle of such an effect can leave the pitch permanently "bent," thereby ruining the performance.

U.S. Pat. No. 5,827,989, issued to Microsoft Corporation on Oct. 27, 1998, entitled "A System and Method For Representing a Musical Event and For Converting the Musical Event Into a Series of Discrete Events," described an invention that alleviated some problems in dealing with continuous events such as pitch bends. In accordance with that patent, a set of incremental musical events such as a series of pitch bend events is represented by a single "curve" event containing parameters defining a continuous event.

Representing on/off events and continuous events as single events rather than discrete time-spaced events has certain advantages in terms of precision and bandwidth. However, many computer synthesizers still require input in the form of conventional, time-spaced, MIDI events. Thus, it is eventually necessary to convert different event representations into MIDI format, and to produce a single stream of timed MIDI commands for submission to a single computer synthesizer. When dealing with multiple input streams, this creates the problems noted above when trying to dynamically halt a particular stream before it has concluded.

SUMMARY OF THE INVENTION

In accordance with the invention, related MIDI commands are represented as respective single data structures. For example, MIDI note-on and note-off commands are consolidated into a single event defined by a start time and a duration. Incremental MIDI commands such as bend events are consolidated into a single curve event, wherein the curve event has parameters allowing the reconstruction of a series of incremental MIDI commands.

When a performance manager receives one of these consolidated events, it determines or calculates the first in a time sequence of individual discrete MIDI commands that will be used to implement the consolidated event. This single MIDI command is then time-stamped with the time it should be played and then placed in a command sequence along with data that allows subsequent commands of the time sequence to be calculated.

The performance manager removes the MIDI commands from the command queue and processes them at the times indicated by their timestamps. Upon removing a non-concluding command of a particular time sequence from the queue, the performance manager determines or calculates the next command in the time sequence, and places it in the queue—again, along with its timestamp and whatever data is needed to calculate further commands of the time sequence.

As an example, an on/off event such as a note event or a pedal event is represented by a consolidated event that includes start time and duration. When the performance manager receives the consolidated event, it places a MIDI note-on command in the command queue, time-stamped with the start time. The duration is also stored in the queue with the note-on command. Upon processing the note-on command and removing it from the command queue, the performance manager places a corresponding note-off command in the queue—time-stamped with the time-stamp of the note-on event plus the indicated duration.

As another example, a consolidated curve event or continuous event includes data enabling the performance manager to calculate a time sequence of MIDI events that implement a particular curve. Upon receiving the continuous event, the performance manager calculates the first MIDI command of the time sequence (such as a discrete pitch bend command), time-stamps it, and places it in the queue along with the original data specifying the curve (so that subsequent bend commands can eventually be calculated). At the time indicated by the timestamp, the performance manager removes the command from the queue and sends it to the synthesizer. In addition, the performance manager calculates the next discrete MIDI event called for by the curve event, and placed it in the queue. The happens repeatedly until the curve event concludes.

This scheme allows dynamic termination and flushing of selected streams. To differentiate events from different streams, each MIDI command placed in the queue is associated with a source identifier to indicate the source of the command. To stop a specific stream, the performance manager searches for all commands associated with the stream's source identifier. Any of these commands that is a note-off command is removed from the queue and played (sent to the synthesizer). Other commands are removed from the queue without being played. If a removed command is part of a continuous or curve event, a reset value is applied to whatever value was the subject of the continuous event. For example, if the continuous event involved a pitch bend, the pitch is reset to the reset value.

As a further aspect of the invention, the time sequence for a continuous event includes a concluding expiration command. The purpose of the expiration Command is to maintain the ability to reset a continuous event for a predetermined time after the event. Upon encountering the expiration command during normal playback, the command is simply removed and ignored, signaling the end of the continuous event. If an expiration event remains in the queue when its stream is halted, however, the presence of the expiration event indicates that the associated reset value should be applied.

BRIEF DESCRIPTION OF THE DRAWINGS

FIG. 1 is a block diagram of a computer environment in which the invention can be implemented.

DETAILED DESCRIPTION

Figure 2:
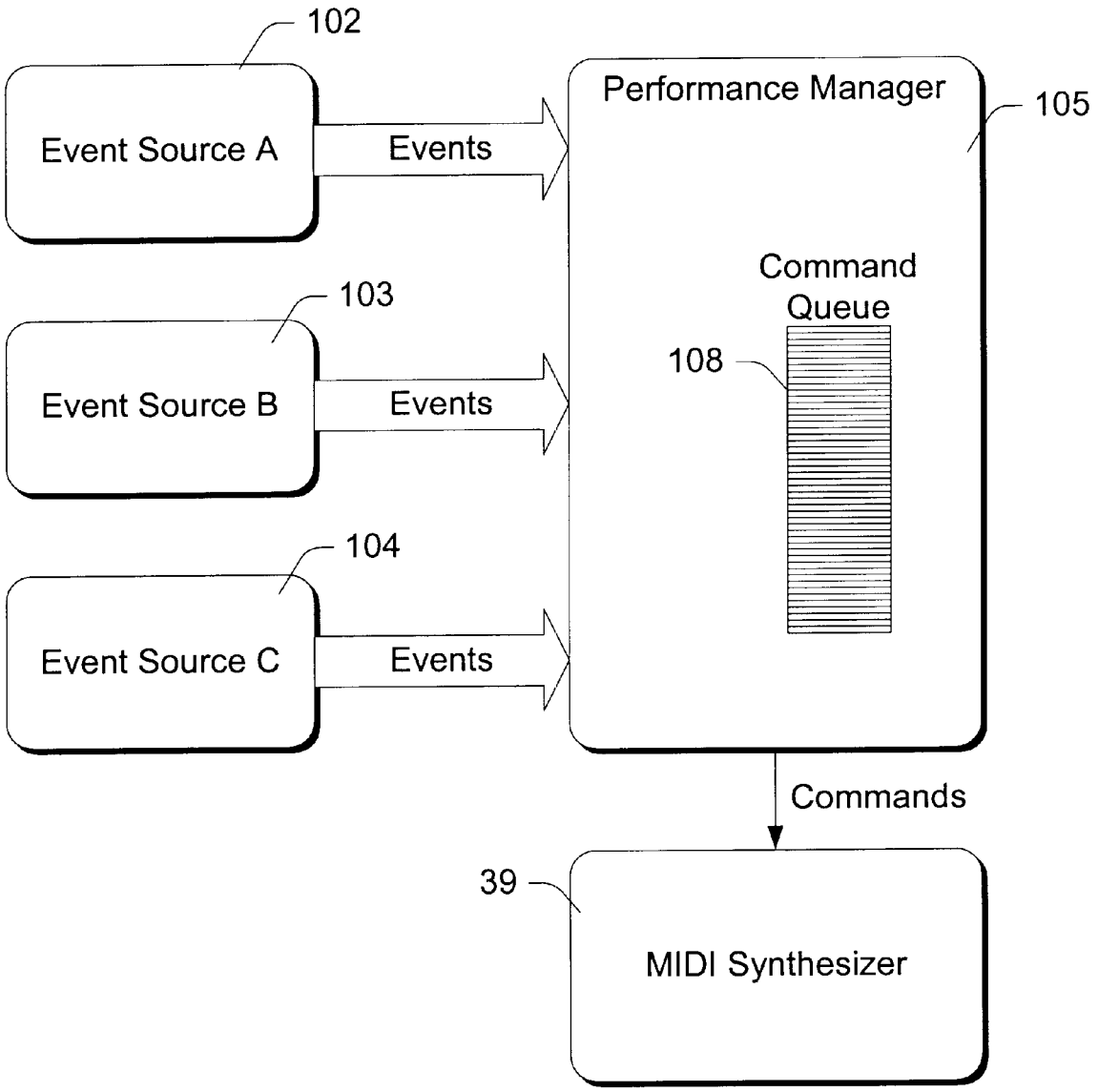
FIG. 2 is a block diagram of a music performance system in accordance with the invention, implemented in conjunction with the computer shown in FIG. 1.

FIG. 1 and the related discussion give a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

Computer 20 includes a musical instrument digital interface ("MIDI") component or music synthesizer 39 that provides a means for the computer to generate music in response to MIDI-formatted data. In many computers, such a MIDI component is implemented in a "sound card," which is an electronic circuit installed as an expansion board in the computer. The MIDI component responds to MIDI commands by rendering appropriate tones through the speakers of the computer. Generally, commands are executed immediately upon being received by synthesizer 39.

Computer 20 includes a musical instrument digital interface ("MIDI") component 39 that provides a means for the computer to generate music in response to MIDI-formatted data. In many computers, such a MIDI component is implemented in a "sound card," which is an electronic circuit installed as an expansion board in the computer. The MIDI component responds to MIDI events by playing appropriate tones through the speakers of the computer.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 1. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at east partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as the "Windows" family of operating systems available from Microsoft Corporation. An operating system of this type can be configured to run on computers having various different hardware configurations, by providing appropriate software drivers for different hardware components.

Consolidated Events

FIG. 2 shows the internal architecture of a system for generating and processing music events in accordance with the invention. The system includes three event sources 102, 103, and 104. These sources are application programs, other program components, or music system objects that generate music events. In accordance with the invention, the music events generated by sources 102–104 are consolidated events. Thus, they do not necessarily correspond to discrete MIDI commands. When the invention is used in conjunction with MIDI rendering components, consolidated events are used to determine or calculate a time sequence of MIDI commands.

An on/off event is an example of a consolidated event. An on/off event is specified in terms of a note, its start time, and its duration. Such an event is eventually converted to discrete MIDI commands—to a MIDI note-on command and a subsequent MIDI note-off command.

A continuous event is another example of a consolidated event. A continuous event is specified by parameters that define a time-varying degree by which a specified performance parameter (such as pitch, volume, etc.) is to be varied. The described embodiment uses a scheme as described in the U.S. Pat. No. 5,827,989 (referenced above). In accordance with this scheme, a set of incremental musical events such as a series of pitch bend commands is represented by a single "continuous" or "curve" event containing parameters that define a time-varying scaling factor. Such parameters might reference a pre-defined type of curve such as a linear ramp or sinusoid. Alternatively, the parameters might define an arbitrary equation that varies with time, thereby producing a time-varying scaling factor by which a specified MIDI value is to be varied.

More specifically, a continuous event can specify sinusoidal, linear, exponential, logarithmic, instantaneous or step curves, and other dynamically defined curves. A particular continuous event is represented as a data structure that indicates: a time value indicating when the event should start; the type of performance parameters (i.e., pitch bend, volume, etc.) to which the curve should be applied; and a list of one or more curves, selected from a predefined set of curves, that represent the degree by which the specified performance parameters are to be varied. It is also possible to utilize so-called "sub-curves" in this data structure, to define more complex curve shapes. As described in the referenced application, continuous event data structures can include different types of parameters, depending on the desired goals. Generally, an event data structure contains whatever information might be necessary for creating a sequence of discrete, time-stamped MIDI command that approximate a desired continuous or incremental effect.

Event sources 102–104 send events to a music processing component 105, also referred to herein as performance manager 105. It is the performance manager's responsibility to convert consolidated events into discrete MIDI commands, and to process the MIDI commands at the appropriate times. In most cases, processing a MIDI command comprises sending it to a MIDI synthesizer or other MIDI rendering component 39 at the appropriate time. Note in this regard that most MIDI rendering components have no provision for command queuing. Rather, MIDI commands are rendered immediately upon being received. Thus, the performance manager is responsible for delivering commands at the precise times at which they are to be rendered.

As noted, a continuous event affects some performance parameter such volume or pitch. In many cases, the continuous event changes the value from its starting point to some ending point. For example, the pitch might be bent upwardly and then eventually returned to its starting value. As another example, the pitch is bent upwardly from one note to another. In some cases, one event accomplishes a parameter variation that is intended to be temporary, and a corresponding subsequent event returns the parameter to its original value. A continuous event is implemented as a time sequence of discrete, incremental, MIDI commands.

In accordance with the invention, continuous events received from music sources 102–104 include a value that is referred to as a reset value. The reset value is a value that is to be applied when halting the continuous event before it has been allowed to complete. If the continuous event applies to volume, for instance, the reset value is a volume value that is applied when the event is terminated before completing. A volume reset value would be applied by sending a MIDI volume command to the synthesizer, indicating the volume reset value.

In accordance with the invention, continuous events received from music sources 102–104 also include a expiration time. The expiration time indicates a time following the last incremental MIDI command of a continuous event, prior to which the reset value of the continuous event is to remain valid and applicable. If an event stream responsible for a continuous event is halted prior to this time, the reset value is applied. If the stream is halted subsequent to the expiration time, the reset value is not applied.

The expiration time accounts for the fact that many pitch bends and similar continuous events are implemented in pairs within a given event stream, with a first event bending the pitch to a temporary value and the second event bending it back to an original value. By setting the expiration time of the first event appropriately, terminating the event prior to initiating the second event will result in the reset value being applied. This allows the original value (or any other value) to be restored, even if the second event is never executed.

Figure 3:
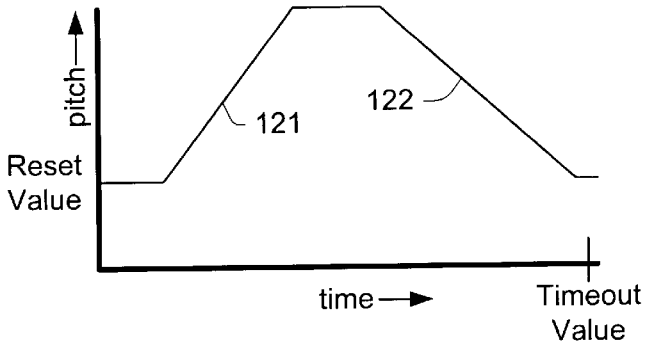
FIG. 3 is a graph that illustrates values associated with continuous events in accordance with the invention.

FIG. 3 illustrates use of reset values and expiration times in conjunction with continuous events. FIG. 3 show a pair of pitch bend events 120 and 122, acting to vary the current pitch of a musical performance. The first pitch bend is specified by an upward, linear curve, which is eventually converted into a series of incremental MIDI commands. Following the first pitch bend, the second pitch bend is specified by a downward linear curve, back down to the original pitch value. Again, this curve is eventually converted to a series of incremental MIDI commands.

In this example, the reset value of the first pitch bend event 120 and of the second pitch bend event 122 is set to the original pitch value, which is the same as the desired ending pitch value. The expiration time of the first pitch bend event 120 is set to a point just after the end of the second pitch bent event 122. The timeout of the second pitch bend event 122 is set to zero, and is not shown.

Suppose that both of these events are contained in a stream from a single event source, and that the stream is prematurely halted at a playback point after the first curve 120 but before the beginning of the second curve 122. Because this is before the expiration time of pitch bend event 120, the reset value of pitch bend event 120 is applied.

The use of a reset value ensures that intended temporary events do not become permanent when a stream is dynamically halted before completion. The use of an expiration time ensures that the reset value remains applicable until a subsequent event has concluded, in situations where the subsequent event is intended to reverse the effects of the first event.

Command Queue Management

Performance manager 105 maintains a command queue 108 for pending MIDI commands. The command queue contains MIDI commands and associated data. Each entry is time-stamped, indicating when the MIDI command should be processed (sent to synthesizer 39). As noted above, MIDI commands are sent to the synthesizer only at the times they are to be played.

As indicated above, performance manager 105 receives music events or music event specifications from a plurality of different streams or music sources such as sources 102–104. A music event might correspond to a simple MIDI command, or might be a consolidated event as described above. Each source or stream is assigned a different numeric or alphanumeric source identifier.

In response to receiving a particular music event or music event specification, the performance manager determines or calculates a time sequence of individual MIDI commands to implement the music event. For example, an on/off music event is implemented by a note-on command and a subsequent note-off command. A continuous or curve event is implemented by a series of incremental MIDI commands. The MIDI commands are time-stamped, indicating the times at which they are to be played, and stored in command queue 108, ordered by their timestamps. In addition, the commands are stamped with the source identifiers of their music sources or streams.

For continuous events, the corresponding time sequence of commands further includes a concluding expiration command that is time-stamped with the expiration time of the event. The purpose of the expiration command will be explained in the following discussion.

The performance manager inserts commands in command queue 108 in this manner, and monitors the command queue for commands whose timestamps indicate they are to be played. When a command is due to be played, the performance manager removes the command from the queue and plays it (except for expiration commands, which are simply discarded).

In actual implementation, as described below, the performance manager does not immediately compute all the individual MIDI commands that will eventually be necessary to implement the received music event. Rather, only the first such command is formulated and placed in the command queue. As each command is removed from the time queue and processed, the performance manager determines whether additional commands are needed to complete the music event. If one or more additional commands are needed, the next command in the sequence is formulated and placed in the queue. As a result of this implementation, there is only one command in the command queue at any given time for any single music event. This preserves memory and facilitates flushing the queue as will become more apparent in the discussion which follows.

Performance manager 105 accepts flush instructions, indicating that the command queue should be flushed of individual commands that implement music events from a particular stream or source. A flush instruction indicates a source identifier corresponding to the source or stream whose commands are to be flushed. In response to receiving such a flush instruction, the performance manager identifies any commands in the command queue having the designated source identifier. Any of the identified commands that are note-off commands are removed from the command queue and played or processed (sent to synthesizer 108). Other commands are simply removed from the command queue and discarded, without processing. In addition, the performance manager examines the identified commands to see whether they are associated with reset values. If they are, the performance manager applies any such reset values.

Figure 4:
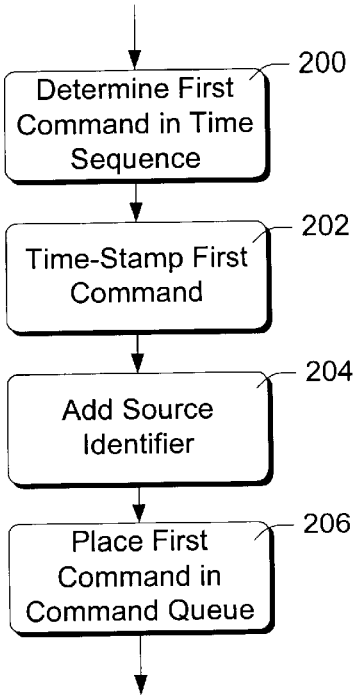
FIG. 4 is a flowchart showing steps performed when receiving a music event from a music source in accordance with the invention.
Figure 5:
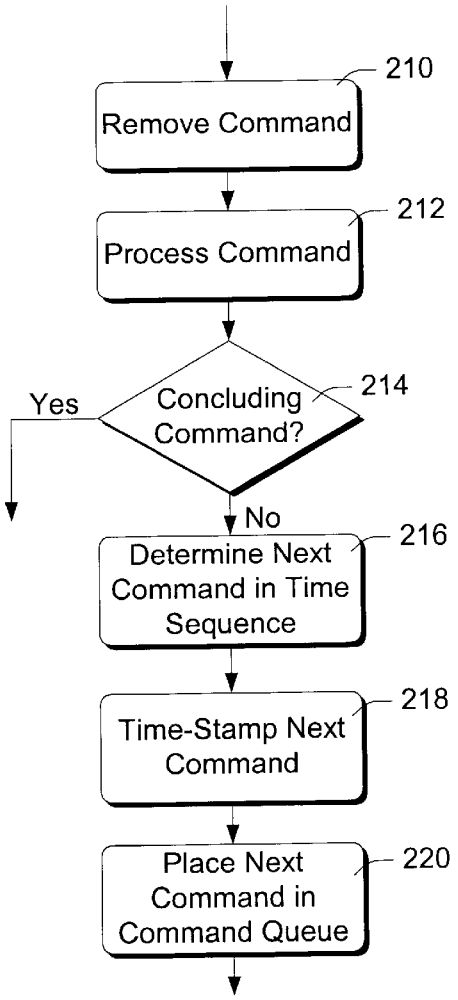
FIG. 5 is a flowchart showing steps performed when processing an individual command from a command queue in accordance with the invention.
Figure 6:
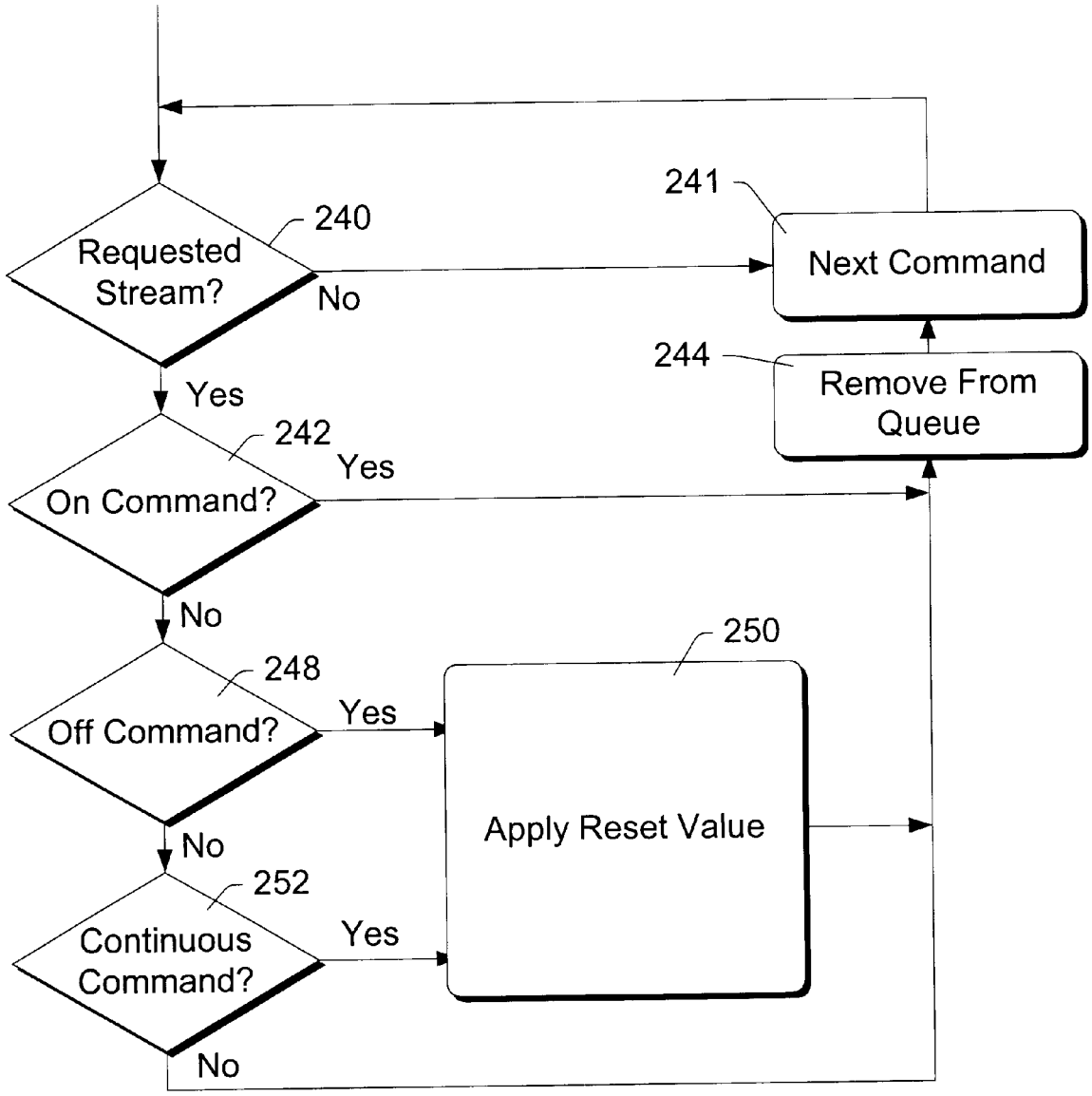
FIG. 6 is a flowchart showing steps performed when flushing a command queue in accordance with the invention.

FIGS. 4–6 shows this general functionality in more detail. FIG. 4 shows steps performed by performance manager 105 when receiving an event from one of music sources 102–104. Step 200 comprises determining the first command in the time sequence of MIDI commands that will be used to implement the received music event. For an on/off event, the first command will be a note-on command. For a continuous event, the first command will be the first in a series of incremental MIDI commands.

Step 202 comprises time-stamping the first command with the time it is to be processed or played.

Step 204 comprises stamping the first command with the source identifier of the music source from which the event was received.

Step 206 comprises placing the first command in the command queue, along with its timestamp, the source identifier, and any other data that might be necessary to calculate further, subsequent MIDI commands of the time sequence. For a continuous event, for example, a reset value and expiration time are stored in a data structure with the first MIDI command. In addition, curve parameters are stored so that subsequent MIDI commands can be calculated.

FIG. 5 shows steps performed by performance manager 105 when processing individual commands from the command queue. The performance manager monitors the command queue and performs the indicated steps with regard to a particular MIDI command when the current time equals the timestamp of that command. With regard to these steps and those of FIG. 3, note that only a single command from any individual time sequence is present in the command queue at any given time. As a command is processed and removed from the queue, a subsequent command from the same music event is calculated and placed in the queue. Individual commands are calculated only at the time when they are placed in the queue.

Steps 210 and 212 comprise removing current command from the command queue and processing it. For all commands except an expiration command, processing the command comprises formatting a MIDI command and sending it to synthesizer 39. If the command is an expiration command, the command is simply removed from the command queue, and no further processing takes place. The expiration command signals the end of a continuous music event.

As indicated in block 214, performance manager 105 determines whether the removed command is the concluding command of its time sequence. For an on/off event, the note-off command is the concluding command. For a continuous event, the expiration command is the concluding command. If the command is the concluding command of its time sequence, the music event responsible for the time sequence is concluded and no further steps are taken with regard to that event and its time sequence.

In response to removing a non-concluding command of a time sequence, a step 216 is performed of determining or calculating the next MIDI command in the event or time sequence of the command that has just been removed from the command queue. This is based on the information stored with the command just removed from the command queue. For example, if the removed command was a note-on command, the next command of the sequence will be a note-off command, to be performed at a time that is calculated as the start time of the on/off event plus its indicated duration. If the removed command was part of a continuous event, the next command will be either another incremental MIDI command (which will be time-stamped to produce the desired curve) or the expiration command (which will be time-stamped with the expiration time indicated for the music event).

Step 218 comprises time-stamping the determined or calculated command with the time at which it is to be played or processed. Step 220 comprises placing the command in the time queue, along with its timestamp, its source identifier, and the other information discussed above which will allow subsequent commands to be calculated.

Flushing the Command Queue

A flush instruction can be sent to performance manager 105 from one of the music sources or from other controlling sources. The flush instruction specifies a source identifier, indicating that all queued commands originating from the corresponding source are to be flushed from the command queue. The flush instruction allows a source to be dynamically halted without allowing it to reach its completion.

Generally, the performance manager responds to a flush instruction by removing all pending commands in the queue that have the specified source identifier. If a particular one of these commands is the first command of either a continuous event or an on/off event (the first command of an on/off event is an on or note-on command), the command is simply removed without processing—the command is not sent to the synthesizer and further commands of the music event's time sequence are not placed in the command queue.

If one of the removed commands is part of a continuous music event and is not the first command of its time sequence, the command is not played or processed. Instead, the reset value associated with the command is applied and sent to synthesizer 39 as part of a MIDI command. This applies similarly to any concluding expiration command—applying the associated reset value is the only action taken when flushing an expiration command from the command queue.

If one of the removed commands is an off or note-off command, the command is immediately processed—it is sent to the synthesizer.

FIG. 6 illustrates these steps in more detail. The steps of FIG. 6 are iterated over each queued command in command queue 108, in response to receiving a flush instruction specifying a particular source identifier. A first step 240 comprises determining whether the currently examined command has a source identifier equal to that specified in the flush instruction. If not, step 241 is executed of advancing to the next command, and step 240 is repeated.

If the current command has the specified source identifier, a step 242 is performed to determine whether the command represents an on or note-on command. If it does, step 244 is performed of simply removing the command from the queue.

If the current command is not an on or note-on command, step 248 comprises determining whether the command is an off or note-off command. If it is, a step 250 is performed of applying a reset value. In this case, the reset value is actually an implied "off" value—a note-off command is sent to synthesizer 39. Execution then continues with step 244, which comprises removing the command from the command queue.

If the current command is not an off or note-off command, step 252 comprises determining whether the command is an incremental MIDI command or an expiration command of a continuous event. If it is, step 250 is performed of applying the reset value associated with the continuous event. In this case, the reset value is explicitly specified as part of the continuous event. Step 244 is then performed of removing the incremental MIDI command from the command queue.

If the current command is not an incremental MIDI command of a continuous event, step 244 is performed of removing the command from the queue without further processing. Alternatively, there might be other types of queued commands that call for special processing.

Step 241 is then performed of moving to the next command in the queue, and starting again with step 240.

Conclusion

The invention provides an efficient way of converting consolidated events to discrete MIDI commands, of queuing the discrete MIDI commands, of playing the MIDI commands, and of flushing queued commands when dynamically halting an event stream before it reaches its conclusion. The described embodiment incurs very little overhead, and allows individual streams to be flushed without affecting other streams. However, it is not necessary to use separate command queues for the different streams. Thus, the invention makes very efficient use of both memory and processing capacities.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of executing a music event, comprising:

determining a time sequence of individual commands to implement the music event, each individual command having a timestamp indicating when the command should be processed;

placing a first of the individual commands and its timestamp in a command queue;

removing and processing individual commands from the command queue at the times indicated by their timestamps;

upon removing a non-concluding individual command of the time sequence from the command queue, placing a subsequent individual command of the time sequence in the command queue along with the timestamp of said subsequent individual command.

2. A method as recited in claim 1, further comprising:

receiving the music events from different music sources;

flushing the command queue of individual commands that implement music events from a particular music source.

3. A method as recited in claim 1, further comprising receiving the music events from different music sources and flushing the command queue of identified individual commands that implement music events from a particular music source, the flushing step comprising:

removing and processing any of the identified individual commands from the command queue that are off commands;

removing any of the identified individual commands that are not off commands from the command queue without processing said removed commands.

4. A method as recited in claim 1, further comprising receiving the music events from different music sources and flushing the command queue of identified individual commands that implement music events from a particular music source, the flushing step comprising:

removing and processing any of the identified individual commands from the command queue that are off commands;

applying any reset values associated with any of the identified individual commands from the command queue;

removing any of the identified individual commands that are not off commands from the command queue without processing said removed commands.

5. A method as recited in claim 1, wherein the determining comprises calculating each subsequent individual command and its timestamp at the time they are placed in the command queue.

6. A method as recited in claim 1, wherein the individual commands are MIDI commands.

7. A method as recited in claim 1, wherein:

the music event is an on/off event that includes a start time and a duration;

the determined individual commands include an on command with a timestamp that indicates the start time;

the determined individual commands include an off command with a timestamp that indicates the start time plus the duration.

8. A method as recited in claim 1, wherein the music event is a continuous event that includes a reset value and an expiration time.

9. A method as recited in claim 1, wherein the music event is a continuous event that includes a reset value and an expiration time, and the determined individual commands include a concluding expiration command with a timestamp that indicates the expiration time.

10. A method as recited in claim 1, wherein:

the music event is a continuous event that includes a reset value and an expiration time;

the determined individual commands include a concluding expiration command with a timestamp that indicates the expiration time;

processing the concluding expiration command comprises concluding the music event.

11. A method as recited in claim 1, wherein the music event is a continuous event that includes a reset value, wherein the determined individual commands of the continuous event include a first command and a concluding expiration command, and wherein the method further comprises:

receiving a flush instruction;

in response to receiving the flush instruction:

immediately reading any individual command of the continuous event that is currently in the command queue;

if said individual command in the command queue is the first individual command of the continuous event, removing said individual command from the queue without processing the removed individual command, and not placing any subsequent individual commands of the continuous event in the command queue;

if said individual command in the queue is not the first command of the continuous event, removing said individual command from the queue without processing the removed individual command, applying the reset value of the continuous event, and not placing any subsequent individual commands of the continuous event in the command queue.

12. A method as recited in claim 1, wherein the music event is an on/off event whose determined individual commands include a first individual command that is an on command and a concluding individual command that is an off command, the method further comprising:

receiving a flush instruction;

in response to receiving the flush instruction:

immediately reading any individual command of the on/off event that is currently in the command queue;

if said individual command in the command queue is the on command, removing said on command from the queue without processing the on command and not placing any subsequent individual commands of the on/off event in the command queue;

if said individual command in the queue is the off command of the continuous event, removing said off command from the command queue and immediately processing said off command.

13. A computer program stored on one or more computer-readable storage media, the computer program comprising instructions to perform the method recited in claim 1.

14. A computer programmed to perform the steps recited in claim 1.

15. One or more computer-readable storage media containing a computer program for processing music events, the program comprising instructions to perform acts comprising:

receiving music event specifications that define a music events, the music events including on/off events and continuous events;

determining time sequences of individual commands to implement different ones of the music events, each time sequence having a first individual command and a concluding individual command;

time-stamping each of the individual commands to indicate when they should be processed;

placing the first individual command of a particular time sequence and its timestamp in a command queue;

removing and processing individual commands from the command queue at the times indicated by their timestamps;

upon removing a non-concluding individual command of said particular time sequence from the command queue, placing a subsequent individual command of the time sequence in the command queue along with the timestamp of said subsequent individual command;

concluding a music event when its concluding individual command is removed from the command queue.

16. One or more computer-readable storage media as recited in claim 15, wherein the music event specifications are received from different music sources, the program further comprising instructions to perform an act comprising flushing the command queue of individual commands that implement music events from a particular music source.

17. One or more computer-readable storage media as recited in claim 15, wherein the music event specifications are received from different music sources, the program further comprising instructions to perform an act comprising flushing the command queue of identified individual commands that implement music events from a particular music source, the flushing further comprising:

removing and processing any of the identified individual commands from the command queue that are off commands;

removing any of the identified individual commands that are not off commands from the command queue without processing said removed commands.

18. One or more computer-readable storage media as recited in claim 15, wherein the music event specifications are received from different music sources, the program further comprising instructions to perform an act comprising flushing the command queue of identified individual commands that implement music events from a particular music source, the flushing further comprising:

removing and processing any of the identified individual commands from the command queue that are off commands;

applying any reset values associated with any of the identified individual commands from the command queue;

removing any of the identified individual commands that are not off commands from the command queue without processing said removed commands.

19. One or more computer-readable storage media as recited in claim 15, wherein the determining comprises calculating each subsequent individual command and its timestamp at the time they are placed in the command queue.

20. One or more computer-readable storage media as recited in claim 15, wherein the individual commands are MIDI commands.

21. One or more computer-readable storage media as recited in claim 15, wherein:

a music event specification for an on/off event includes a start time and a duration;

the determined individual commands to implement an on/off event include an on command whose timestamp indicates the start time and an off command whose timestamp indicates the start time plus the duration.

22. One or more computer-readable storage media as recited in claim 15, wherein a music event specification for a continuous event includes a reset value and an expiration time.

23. One or more computer-readable storage media as recited in claim 15, wherein a music event specification for a continuous event includes a reset value and an expiration time, and the determined individual commands to implement the continuous event include a concluding expiration command whose timestamp indicates the expiration time.

24. One or more computer-readable storage media as recited in claim 15, wherein:

a music event specification for a continuous event includes a reset value and an expiration time;

the determined individual commands to implement the continuous event include a concluding expiration command whose timestamp indicates the expiration time;

processing the concluding expiration command comprises concluding the continuous event.

25. One or more computer-readable storage media as recited in claim 15, wherein a music event specification for a continuous event includes a reset value, wherein the determined individual commands to implement the continuous event include a first command and a concluding expiration command, and wherein the program further comprises instructions to perform acts comprising:

receiving a flush instruction;

in response to receiving the flush instruction:

immediately reading any individual command of the continuous event that is currently in the command queue;

if said individual command in the command queue is the first individual command of the continuous event, removing said individual command from the queue without processing the removed individual command, and not placing any subsequent individual commands of the continuous event in the command queue;

if said individual command in the queue is not the first command of the continuous event, removing said individual command from the queue without processing the removed individual command, applying the reset value of the continuous event, and not placing any subsequent individual commands of the continuous event in the command queue.

26. One or more computer-readable storage media as recited in claim 15, wherein the determined individual commands to implement an on/off event include a first individual command that is an on command and a concluding individual command that is an off command, the program further comprising instructions to perform acts comprising:

receiving a flush instruction;

in response to receiving the flush instruction:

immediately reading any individual command of the on/off event that is currently in the command queue;

if said individual command in the command queue is the on command, removing said on command from the queue without processing the on command and not placing any subsequent individual commands of the on/off event in the command queue;

if said individual command in the queue is the off command of the continuous event, removing said off command from the command queue and immediately processing said off command.

27. One or more computer-readable storage media containing a computer program for processing music events, the program comprising instructions to perform acts comprising:

receiving music event specifications from a plurality of different music sources;

assigning respective source identifiers to the different music sources;

determining a time sequence of individual commands to implement a received music event specification;

associating each of said individual commands of the time sequence with the source identifier of the music source of said received music event specification;

time-stamping each of the individual commands of the time sequence to indicate when they should be processed;

placing a first of the individual commands of the time sequence, its timestamp, and its source identifier in a command queue;

removing and processing individual commands from the command queue at the times indicated by their timestamps;

upon removing a non-concluding individual command of particular time sequence from the command queue, placing a subsequent individual command of the time sequence, its timestamp, and its source identifier in the command queue;

receiving a flush instruction for a particular music source having a particular assigned source identifier;

in response to receiving the flush instruction:

identifying any individual commands in the command queue having the particular assigned source identifier;

removing and processing any of the identified individual commands from the command queue that are off commands;

removing any of the identified individual commands that are not off commands from the command queue without processing said removed commands.

28. One or more computer-readable storage media as recited in claim 27, the program further comprising instructions to perform an act comprising, in response to receiving the flush instruction, applying any reset values associated with any of the identified individual commands from the command queue.

29. One or more computer-readable storage media as recited in claim 27, wherein the determining comprises calculating each subsequent individual command and its timestamp at the time they are placed in the command queue.

30. One or more computer-readable storage media as recited in claim 27, wherein the individual commands are MIDI commands.

31. One or more computer-readable storage media as recited in claim 27, wherein:

the music events include on/off events;

a music event specification for an on/off event includes a start time and a duration;

the determined individual commands to implement an on/off event include an on command whose timestamp indicates the start time and an off command whose timestamp indicates the start time plus the duration.

32. One or more computer-readable storage media as recited in claim 27, wherein:

the music events include continuous events;

a music event specification for a continuous event includes a reset value and an expiration time;

the determined individual commands to implement the continuous event include a concluding expiration command whose timestamp indicates the expiration time.

33. One or more computer-readable storage media as recited in claim 27, wherein:

the music events include on/off events and continuous events;

a music event specification for an on/off event includes a start time and a duration;

the determined individual commands to implement an on/off event include an on command whose timestamp indicates the start time and an off command whose timestamp indicates the start time plus the duration;

a music event specification for a continuous event includes a reset value and an expiration time;

the determined individual commands to implement the continuous event include a concluding expiration command whose timestamp indicates the expiration time.

34. One or more computer-readable storage media as recited in claim 27, wherein:

the music events include continuous events;

a music event specification for a continuous event includes a reset value and an expiration time;

the determined individual commands to implement the continuous event include a concluding expiration command whose timestamp indicates the expiration time;

processing the concluding expiration command comprises concluding the continuous event.

35. One or more computer-readable storage media as recited in claim 27, wherein a music event specification for a continuous event includes a reset value, wherein the determined individual commands to implement the continuous event include a first command and a concluding expiration command, and wherein the program further comprises instructions to perform acts comprising:

in response to receiving the flush instruction:

if a particular one of the identified individual commands includes a reset value, removing said particular individual command from the command queue without processing the removed individual command and applying the reset value.

36. A system for processing music events, comprising:

at least one music processing component;

a plurality of different music sources that provide music events to the music processing component, wherein the music events comprise on/off music events and to continuous music events;

each of the different music sources being associated with a respective source identifier;

a command queue;

wherein in response to receiving a music event, the music processing component (a) determines a first individual command of a time sequence of individual commands that implement the music event, (b) determines a timestamp for the first individual command, indicating when the first individual command should be processed, (c) associates the first individual command with the source identifier of the music source of said received music event, and (d) places the first of the individual commands, its timestamp, and its source identifier in the command queue;

wherein the music processing component removes and processes individual commands from the command queue at the times indicated by their timestamps;

wherein upon removing a non-concluding individual command of particular time sequence from the command queue, the music processing component (a) determines a subsequent individual command of the particular time sequence, (b) determines a timestamp for the subsequent individual command, indicating when the subsequent individual command should be processed, (c) associates the subsequent individual command with the source identifier of non-concluding individual command, and (d) places the subsequent individual command, its timestamp, and its source identifier in the command queue;

wherein upon receiving a flush instruction for a particular music source having a particular assigned source identifier, the music processing component:

identifies any individual commands in the command queue having the particular assigned source identifier;

removes and processes any of the identified individual commands from the command queue that are off commands;

removes any of the identified individual commands that are not off commands from the command queue without processing said removed commands.

37. A system as recited in claim 36, wherein in response to receiving the flush instruction the music processing component applies any reset values associated with any of the identified individual commands from the command queue.

38. A system as recited in claim 36, wherein the individual commands are MIDI commands.

39. A system as recited in claim 36, wherein:

an on/off event includes a start time and a duration;

the determined individual commands to implement an on/off event include an on command whose timestamp indicates the start time and an off command whose timestamp indicates the start time plus the duration.

40. A system as recited in claim 36, wherein:

a continuous event includes a reset value and an expiration time;

the determined individual commands to implement the continuous event include a concluding expiration command whose timestamp indicates the expiration time.

41. A system as recited in claim 36, wherein:

an on/off event includes a start time and a duration;

the determined individual commands to implement an on/off event include an on command whose timestamp indicates the start time and an off command whose timestamp indicates the start time plus the duration;

a continuous event includes a reset value and an expiration time;

the determined individual commands to implement the continuous event include a concluding expiration command whose timestamp indicates the expiration time.

42. A system as recited in claim 36, wherein:

a continuous event includes a reset value and an expiration time;

the determined individual commands to implement the continuous event include a concluding expiration command whose timestamp indicates the expiration time, the music processing component processes the concluding expiration command by concluding the continuous event.

43. A system as recited in claim 36, wherein a continuous event includes a reset value, wherein the determined individual commands to implement the continuous event include a first command and a concluding expiration command, and wherein in response to receiving the flush instruction the music processing component performs the following steps:

if a particular one of the identified individual commands includes a reset value, removing said particular individual command from the command queue without processing the removed individual command and applying the reset value.

* * * * *

UNITED STATES PATENT AND TRADEMARK OFFICE

CERTIFICATE OF CORRECTION

PATENT NO : 6,150,599

DATED : Nov. 21, 2000

INVENTOR(S) : Todor C. Fay et al.

It is certified that error appears in the above-identified patent and that said Letters Patent are hereby corrected as shown below:

Column 7, line 33, change "thc" to --the--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*